United States Patent [19]

von Resch

[11] Patent Number: 4,562,667

[45] Date of Patent: Jan. 7, 1986

[54] PANEL CLOSURE ASSEMBLY FOR WINDOW, DOOR OR THE LIKE

[75] Inventor: Julius M. von Resch, Stuttgart, Fed. Rep. of Germany

[73] Assignee: Gretsch-Unitas GmbH, Ditzingen, Fed. Rep. of Germany

[21] Appl. No.: 589,555

[22] Filed: Mar. 14, 1984

[30] Foreign Application Priority Data

Mar. 19, 1983 [DE] Fed. Rep. of Germany ..... 3310020

[51] Int. Cl.[4] ..... E05D 15/22

[52] U.S. Cl. ..... 49/176; 49/130; 49/209; 49/221

[58] Field of Search ..... 49/176, 187, 217, 219, 49/128–130, 209, 222, 223, 221, 193

[56] References Cited

U.S. PATENT DOCUMENTS 2,337,632 12/1943 Winser ..... 49/193 X 2,374,618 4/1945 Perreton ..... 49/193 X 3,660,936 5/1972 Bryson ..... 49/209

3,775,905 12/1973 Frank ..... 49/176 X 4,453,345 6/1984 Maus ..... 49/176 X

*Primary Examiner*—Philip C. Kannan

*Attorney, Agent, or Firm*—Toren, McGeady, Stanger, Goldberg & Kiel

[57] ABSTRACT

A closure panel assembly including a frame member and a panel member adapted to be tilted relative to the frame member and also laterally offset relative thereto by movement parallel to itself is equipped with a panel latching mechanism which includes a locking member engaging between the panel member and the frame member to lock the lower end of the panel member relative to the frame member when the panel member is to be moved to its tilted position while enabling release of the lower end of the panel member when the panel member is to be parallel laterally offset.

20 Claims, 11 Drawing Figures

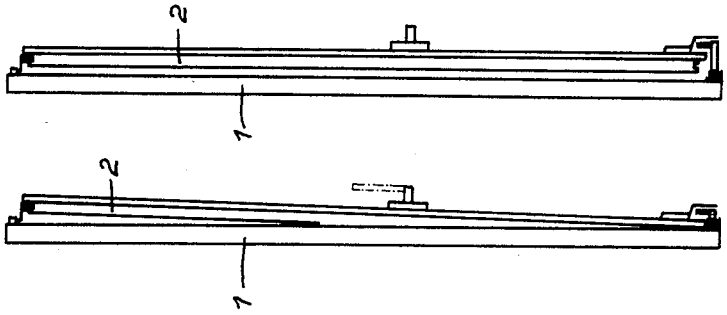
Fig. 3
Fig. 2
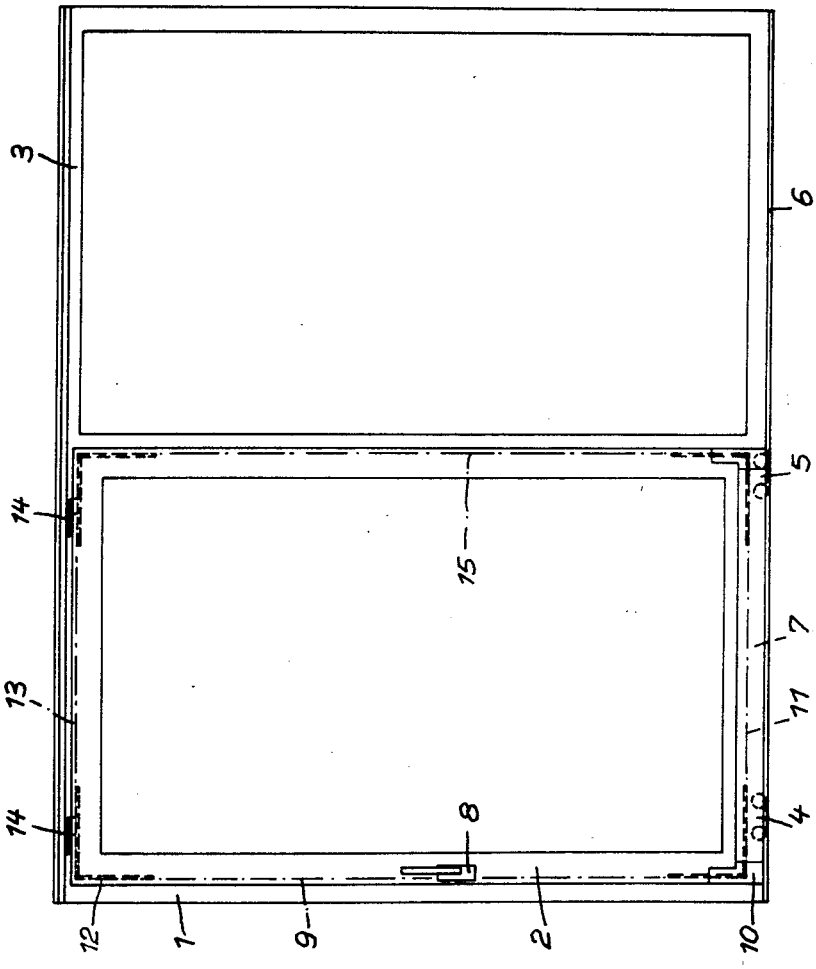
Fig. 1

PANEL CLOSURE ASSEMBLY FOR WINDOW, DOOR OR THE LIKE

The present invention relates generally to a panel closure assembly particularly useful with doors, windows or the like and more particularly to a closure assembly including a panel member which is mounted on a frame member, the panel member being tiltable relative to the frame member and also adapted to be laterally offset parallel to itself relative to the frame member.

Panel assemblies of the type to which the invention relates may include locking and linkage means operated by an actuating element and extending from the actuating element at least along the lower end of the panel. In some structures, the laterally offset panels are first brought into a tilted position and they are then released also at their lower end whereby they can occupy the laterally offset parallel position relative to the fixed frame. In this laterally offset parallel position they are then adapted to slide along a second fixed or movable panel wall or the like. In the tilted position, such panels are relatively burglarproof especially if the panel is only slightly tilted so as to provide a narrow opening for ventilation at the top thereof.

However, a different situation exists where the tilted panel can be brought into the parallel laterally offset position where it may then be capable of sliding to one side in order to provide a rather large opening. Under such circumstances, undesired intrusion can be easily accomplished.

Therefore, the present invention is directed toward development of a fitting assembly for panel closure mechanisms of the type described such that when the panel is in the tilted position it may be secured against undesired lateral offsetting thereof by movement parallel to itself.

SUMMARY OF THE INVENTION

Briefly, the present invention may be described as a panel assembly for a window, door or the like comprising a frame member, a panel member mounted on said frame member for movement between a closed position and opened positions, said panel member being tiltable relative to said frame member at the lower end thereof and also being adapted to be laterally offset relative to the frame member by movement of the panel member parallel to itself, and panel latching means including an actuating element and linkage means operable through said actuating element extending from said actuating element at least along the lower end of said panel, said panel member at said lower panel end being coupled for outward movement with said frame member through lock means adapted to be released by said linkage means, said lock means being adapted to be moved to a release position to enable said outward movement of said lower panel end.

In accordance with the present invention, when the panel is brought from the locked position into the tilted position, the laterally offset parallel position may subsequently be achieved only if the lock at the lower panel end has first been released manually by way of the lock linkage. Thereafter, the panel may be laterally offset parallel to itself and if needed it may also be pushed or rolled to one side. Releasing the lock does not necessarily result in a change in the laterally offset parallel position if this position is not achieved automatically or semiautomatically it may be brought about manually or by some other special design of the fitting after the lock has been released. The lock linkage is actuated through a handle, preferably a rotatable lever. The handle operating as an actuating element also operates to release the locking mechanism relative to the fixed frame and if the fitting so provides it may also operate to bring about the tilted position. In a contrary case, the tilted position is obtained after release of the locking mechanism, for example by a simple pulling action on the lever or actuating element.

In accordance with a further modification of the invention, at least one latch element is fastened on a lower cross member or the like of the fixed frame and a latch member which is nonslidably connected can be coupled with the drive rod of the lock linkage and may be slidably guided on a cuff bar, whereby in the locking position it may engage from behind by a latch lug a latch edge of the latch element. The latch member must be correlated with the latch element in such a manner that the shift movement of the lock linkage necessary for disengagement is in correct correlation with possibly preceding shift movements of the lock linkage. Therefore, if the lock linkage, for example when changing over from the closing position to the tilted position, moves from right to left, then the disengaging movement must also take place from right to left so that a codirectional disengaging movement can follow the movement of the drive rod for the tilting movement.

In accordance with a preferred embodiment of the invention, the latch member is displaceable into the disengaged position against the force of a return spring, the return spring being a helical compression spring which is inserted between the latch member and an edge, surface or the like of the panel member. A drive rod moves the latch member in the disengagement direction while simultaneously tensioning or increasing the tension of the return spring. At the end of the stroke of the drive rod, maximum tension of the return spring and at the same time, or perhaps somewhat earlier, the disengagement position is reached. If the drive rod is then released, the return spring will push the drive rod and all the parts coupled therewith, particularly the latch member, back into the starting position. If it should then be desired to bring the panel from the parallel laterally offset position back to the tilted position, either the lock must be designed so that this return movement is readily possible or the drive rod must first be brought into a slide position suitable for disengagement. An appropriate design of the lock will provide the advantage that with the movement back of the laterally offset panel into the tilt position, the tilted panel will be again automatically locked.

In a further aspect of the invention the latch member traverses an opening in a cuff bar of the lock linkage which, seen in the lengthwise direction of the cuff bar, extends over approximately the length of the latch member in this region plus the maximum displacement of the latch member, the return spring being inserted between the latch member and a transverse edge of the opening. Therefore, the opening in the cuff bar, which is necessary in any event for passage of the latch member coupled or to be coupled with the drive rod, may then be utilized additionally for supporting the return spring.

By a further feature of the invention, a ramp for the latch lug of the latch member is provided on the latch element, the ramp and the lug cooperating when the panel is pivoted from the parallel offset position into the tilted position. In this respect, therefore, the appropriate design indicated above for the lock is involved, which automatically becomes active again when the parallel offset panel is brought back into the tilted position.

A rather advantageous aspect of the invention may be developed by forming the latch element in a plane perpendicular to the axis of the drive rod for left hand or right hand abutment with the latch member being in a plane parallel to the plane of the panel and passing through the longitudinal median axis of the cuff bar, both symmetrically. As indicated this permits right hand and left hand abutment of the lock and due to the fact that two latch lugs are arranged symmetrically on the longitudinal median axis, the latch member is as a result formed in a forked configuration at its end toward the latch element. The latch element has essentially a trapezoidal form with latch edges formed at both ends.

In another preferred form of the invention, the drive rod is coupled with the latch member part of a corner bend or with the horizontal leg thereof or an extended drive rod, the actuating lever of the fitting being in drive connection with the vertical leg of the corner bend or with a vertical drive rod coupled therewith. If the drive rod and the latch member are part of a corner bend, this is to be understood in the sense that the latch member is fastened or can be coupled to the displaceable force deflecting means of the corner bend.

In accordance with a further aspect of the invention, it is provided that the actuating element is in drive connection with the drive rod by means of a window gear or gear olive and a catch fast to the drive rod, the gear being a three position gear provided with switch positions such as "lock", "tilt" and "parallel offset". The phrase "three position gear" should be understood to mean a gear which starting from a first position can be brought successfully into two additional positions, with the two "switch movements" possibly being quite different in amount and in fact preferably so. The three "switch positions" exist analagously also when a gear olive is used instead of the three position gear. When bringing the three position gear or the like from the locking to the tilting position, the actuating element normally executes a rotation of 90°. If thereafter the parallel offset position is to be assumed the actuating element is further turned in the same direction preferably by about 20° more. It will be immaterial in this connection whether with the first 90° rotation there is reached only a tilt readiness position from which the panel may be brought into the tilted position manually or whether the fitting accomplishes this tilting automatically due to some special design, particularly in the region of the releasing device at the upper panel end.

Similar considerations also apply to the parallel offset position and it too can therefore be brought about automatically through the fitting or if through the operating element only a parallel offset readiness position can be reached from which the panel does not automatically move into the parallel offset position. In this case, it is simply necessary to pull the panel toward the interior of the room, particularly with the aid of the lever until it stands parallel to the fixed frame. For automatic transition to the parallel offset position, however, the angle of rotation should be substantially greater than 20°, for example 90°.

In a further advantageous modification of the invention, an additional return spring which is adapted to be placed under tension upon displacement of the drive rod into the parallel offset position is inserted between the closure side drive rod and a panel side fixed stop in the tilt position of the fitting. It supports the return spring at the lower panel end in a restorative sense. In this connection it is significant if the actuation fitting extends over at least the lower end and the closure side end of the panel and this is even more applicable if there are drive rods also at the upper or at all four members of the panel. In the latter case, additional return springs may be applied to the balance of the corner bends.

In accordance with a further modification of this fitting the additional return spring is inserted between two support members connected with the closure side cuff bar and the spring and abutting this support spring, being located in the movement area of the catch, with the catch impinging on the spring and approximately in a tilt position of the fitting, with a catch of the closure side drive rod being able to move past the support member facing the corner bend or, respectively, past the lower member of the corner bend. During the first quarter rotation of the actuating element, nothing changes in the tension of the additional return spring; that is if it is not tensioned it will remain untensioned when changing over from the closing position into the tilting or tilt-readiness position. Thereafter however the catch nonslidingly coupled with the closure side drive rod impinges on the end associated therewith of the additional return spring and takes this end along with continuous increases of the restoring force. The end of the second rotational movement, the maximum restoring force both of this additional return spring and of the return spring at the lower panel end is reached. Both together push the drive rod and all parts coupled therewith back into the starting position as soon as the actuating element is released. The term "starting position" is understood here to mean the position which is reached at the end of the first rotational movement; that is the tilting or tilt readiness position. The two support members for the additional return spring are advantageously located at the closure side cuff bar piece belonging to the corner bend. In this case also the catch is a component part of the corner bend.

In accordance with a rather advantageous aspect of the invention, the drive rod is coupled with the latch member for the formation of a dead motion path of movement by means of a peg-slot connection, the dead motion path corresponding to the displacement path of the drive rod during transition from the locking to a tilting or tilt readiness position. This design enables meaningful utilization of a three position gear or of a corresponding gear with olive, the switching from the tilting into the parallel offset position being possibly preceded by a switching process with which a lock can be released and the tilting or tilt readiness position brought about. The same is also applicable, of course, when bringing the tilted panel back to the closed position with subsequent locking.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF THE DRAWINGS

In the drawings:

FIG. 1 is a plan view of a panel closure assembly for a door as seen from the inside of the room equipped in accordance with the invention;

FIG. 2 is a side view of the assembly of FIG. 1 showing a panel thereof in the tilted position;

FIG. 3 is a side view similar to FIG. 2 but showing the panel of the assembly in the laterally offset parallel position;

DETAILED DESCRIPTION OF THE PREFERRED EMBODIMENT

Figure 4:
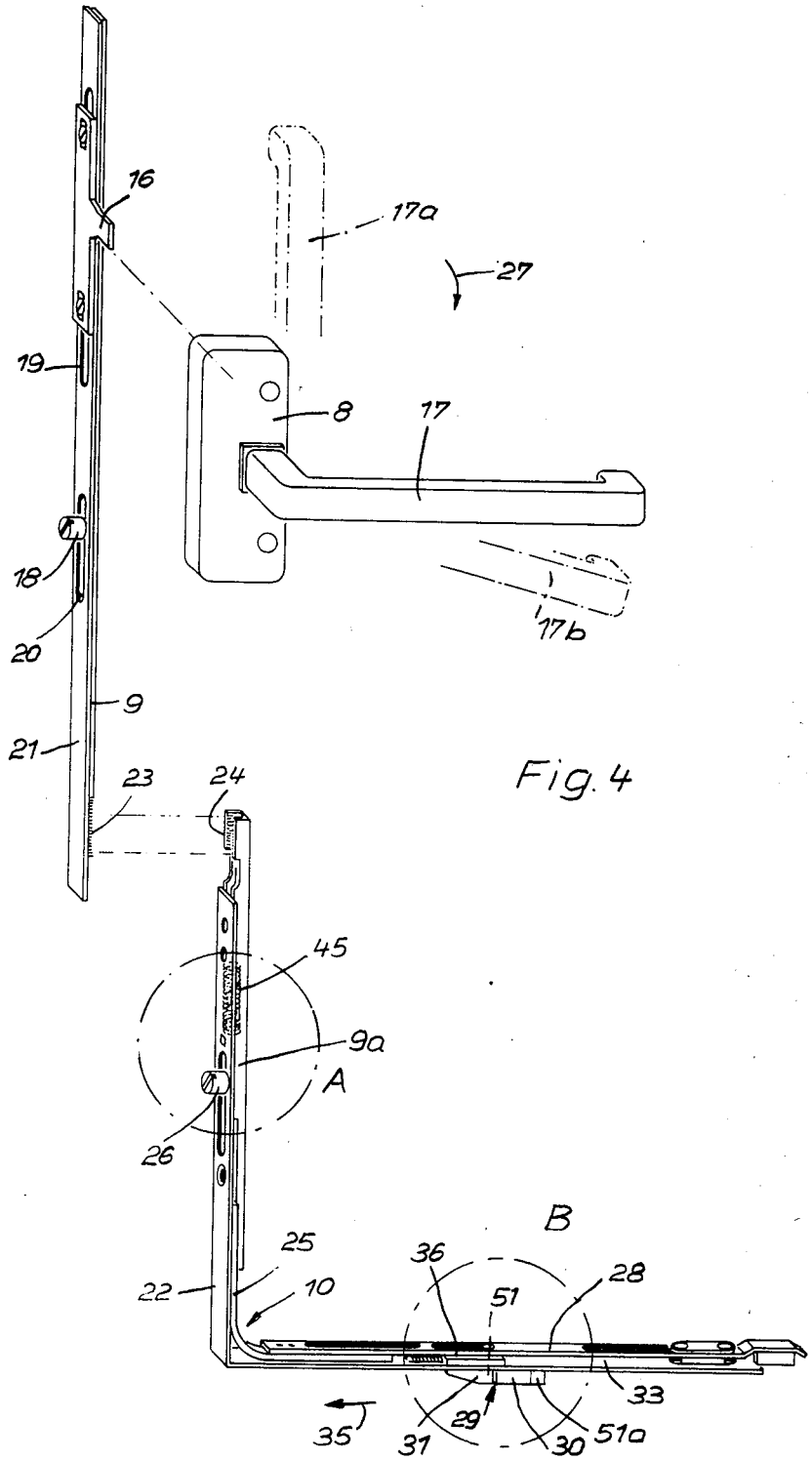
FIG. 4 is an exploded perspective view showing essential parts of the fitting of the invention.

The present invention is adapted to be used in a door or window closure assembly of the type depicted in FIGS. 1–3 wherein there is provided, as shown in the drawings, a fixed or blind frame 1 having therein a panel 2 which may be a door panel or the panel of a window. In the assembly depicted in FIGS. 1–3, the panel 2 is mounted so as to be capable of being tilted about its lower edge or axis so that the upper edge of the panel 2 will be separated from the frame 1. This tilted position of the panel 2 is depicted in FIG. 2.

In addition to being capable of achieving a tilted position, the panel 2 is also capable of being laterally offset parallel to itself relative to the frame 1 and this parallel offset position is depicted in FIG. 3.

When the panel 2 is moved into the parallel laterally offset position shown in FIG. 3 it may be moved sideways within its own plane so as to lie in front of a fixed area 3 which may for example be another glazed panel. Of course, it is also possible that the additional panel may be, for example, a rotary or turning panel or a panel which is movable in some other way. In any case, the panel 2 is supported preferably through two carriages 4 and 5 or a rail 6 in a tiltable and slidable manner, the rail being possibly firmly connected with a lower cross member 7 of the blind frame 1.

The panel 2 is equipped with a three position gear, as explained in the foregoing, or preferably with a gear olive 8 and with a catch member which is fastened on a vertical drive rod 9. The vertical drive rod 9 is in driving connection with a horizontal drive rod 11 at a lower corner 10 of the assembly. In the embodiment shown in FIG. 1, two additional corners are provided and an additional vertical drive rod 15 is arranged in drive connection at the lower corner opposite the corner 10.

The gear olive 8 which is to be coupled with a catch 16 is provided with a handle 17, and when the panel 2 is in the closed and locked position, the handle 17 is in a position pointing upwardly, this position being best seen in FIG. 4 and shown in dashed-dot line form. In addition to the catch 16, there is also firmly connected with the drive rod 9 at least one lock bolt 18. Both of these elements, or, respectively, their attachment elements, will traverse slots 19, 20 of a cuff bar 21. The lock bolt or bolts cooperate in a known manner with locking areas and the like of the blind frame 1. On the closure side of the cuff bar of the blind frame 1. On the closure side of the cuff bar 21, the bar is connected with an angular cuff 22 of the corner 10 or it respectively abuts on the vertical leg of this cuff. Additionally, the vertical drive rod 9 is coupled by means of an adjustable toothed coupling including toothed members 23 and 24 with corner bend means 25 of the corner 10 or, respectively, with the lower section **9*a* of the drive rod connected with the corner bend means, which section carries an additional lock bolt 26**.

Unlocking of the closed panel 2 may be accomplished by turning the handle 17 in a direction indicated by arrow 27 from the position **17*a* into a position shown in solid line form in FIG. 4. This movement may be associated with actuation of releasing scissor levers 14 which are provided at the upper end of the panel 2 between the panel 2 and the frame 1 or it may lead to a release position of the scissor levers so that by pulling on the handle 17 the panel 2** may be brought into the tilt position indicated in FIG. 2.

The parallel offset position of the panel 2 is however not readily capable of being achieved due to the fact that the lower end of the panel is at first retained in a secured position by means of a lock 29, the structural details of which may be more clearly seen in FIGS. 8–11. The lock 29 includes a latch element 30 which is fastened to the lower part of the frame member 1. Corresponding attachment screws 32 seen in FIG. 11 connect the member 30 to the frame. The lock also includes a latch member 31 which, in the embodiment depicted, is slidably mounted on a cuff bar 33 of the corner 10. A corresponding longitudinal guide 38 is formed by the cuff bar by a punched out arrangement.

Figure 8:
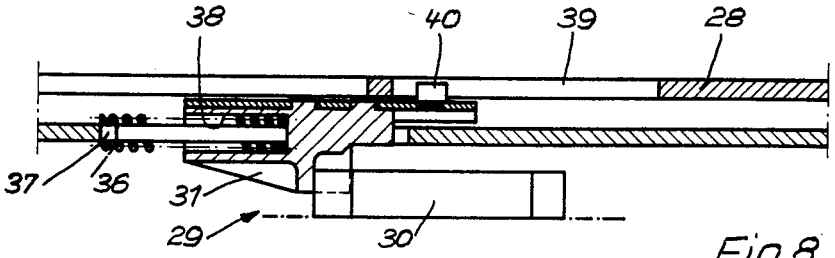
FIGS. 8–10 are sectional views similar to FIGS. 5–7 showing a detail B of FIG. 4 and depicting different positions of certain parts thereof.
Figure 9:
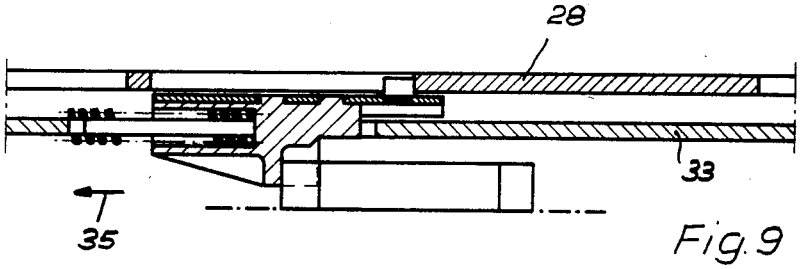
Figure 10:
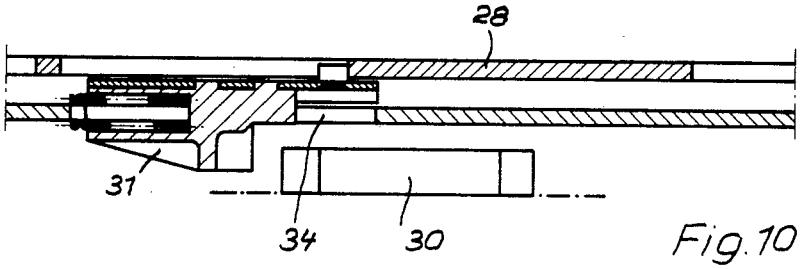

As will be seen in FIGS. 8–10, the latch member 31 is slidable in the direction of the arrow 35 against the resistance of a return spring 36. The spring 36 is formed preferably as a helical compression spring and at one end, particularly the left end as seen in FIG. 8, an opening 34 is formed in the cuff bar 33 which serves as a longitudinal guide with a lug 37 on which the left end of the spring is fitted. The right end of the spring protrudes into a comparatively long bore 38 of the latch member 31 so that the spring as a whole is securely guided.

In the embodiment of the invention depicted and described herein, there is provided a drive rod 28 which is not rigidly coupled with the latch member 31 but which is instead arranged so that a lost motion path is interposed in the actuating movement of the drive rod 28. For this purpose, the drive rod 28 is provided with a slot 39 into which there extends a peg 40 of the latch member 31.

When the panel 2 is in the locked position the latching mechanism of the invention will be in the condition shown in FIG. 8. Thus, the peg 40 will be correlated with one end region, i.e., the left end as seen in the drawing, of the slot 39. However, upon actuation of the fitting or handle 17 from the position **17*a* into the solid line position shown in FIG. 4, the drive rod 28 is moved from the position shown in FIG. 8 into the position shown in FIG. 9 so that relative motion of the peg 40 within the slot 39 will occur, which motion corresponds to the lost motion path provided in the latching mechanism. At the end of the unlocking and also possibly the gear controlled release of the panel into the tilted position, the right end of the slot 39 will come into abutment on the peg 40 or it will at least come into its vicinity. With a further stroke of the drive rod 28 in the direction of arrow 35, which may be achieved by further rotation of the handle 17 in the direction 27 by preferably about 20°, the free end of the handle 17 thus pointing obliquely downward like a door handle at the end of its second rotary movement, which position is shown in dash-dot line at 17***b*, the drive rod 28 will then move the peg 40 along therewith in the direction of the arrow 35 and thus the latch member 31 will be displaced in this direction against the resistance of the return spring 36.

Figure 11:
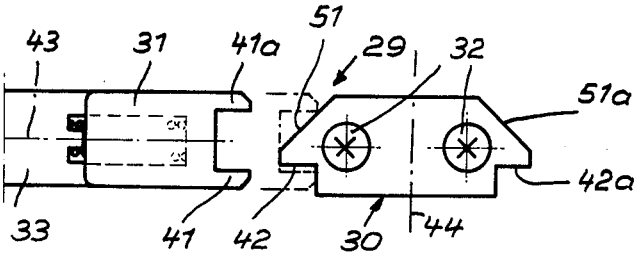
FIG. 11 is a plan view of a detail of the parts shown in FIGS. 8–10.

In FIG. 11 there is shown the relative positioning of the latch member 31 and the latch element 30. The relative positioning which these two elements will achieve when the latching mechanism is in the position shown in FIGS. 8 and 9 is depicted in FIG. 11 with the location of the latch member 31 being shown in dash-dot lines. Thus, it will be seen that a latch lug 41 of the latch member 31 will engage behind a latch edge 42 of the latch element 30. As a result of this engagement, the lower edge of the panel 2 will be held in the position shown in FIG. 2 and will be prevented from moving laterally outwardly from the frame 1. The mechanism shown in FIG. 11 is provided with a second latch lug 41*a* on the latch member 31 and with a second latch edge 42*a* on the latch element 30. As a result, the locking system of the invention may permit left hand and right hand abutment of the lock 29. The latch member 31 is symmetrical relative to the longitudinal median axis 43 and the latch element 30 to the axis 44. The positions shown in FIGS. 8 and 9 will be achieved when the elements in FIG. 11 are in the position indicated in dash-dot lines and the position of the latching mechanism depicted in FIG. 10 will be achieved when the elements indicated in FIG. 11 are in the form shown in solid line. Thus, when the position of FIG. 10 is achieved, the latch member 31 will disengage from the latch element 30 and the latch lug 41 will move out from behind the latch edge 42 and when the lock 29 is in this unlatched condition, it is then possible to move the panel 2 into the parallel offset position depicted in FIG. 3. This is brought about for example in that under its own weight the panel in conjunction with an especially smooth running bearing means of its releasing arms will automatically move into the parallel offset position. There may at least be expected or achieved support of this movement.

When therefore the handle 17 is released, the return spring 36 will cause a sliding back of the latch member 31 and the latter will then turn and take the drive rod 28 along with it in a direction counter to the arrow 35. Accordingly, the handle will move counter to the arrow 27 in the direction of the position shown in solid line in FIG. 4 for the handle 17.

Because the force of the spring 31 particularly when the drive rods go all the way around as provided in the depicted embodiment may not be quite sufficient, or the return takes place sluggishly, there is provided at the vertical leg of the corner 10 an additional return spring 45 which supports this return movement and which is likewise tensioned as the lock is being unlatched. Additional return springs may be installed if necessary.

The additional return spring 45 is inserted between two support members 46 and 47 connected with the closure side cuff bar 22. The lower support member 46 is comparatively flat and has a spike 48 for insertion into the lower spring end. At the vertical lower section 9*a* of the drive rod 9, which is appropriately U-shaped or double walled, there are two catches 49 which can move past the lower support member 46 laterally forwardly and rearwardly as seen in FIGS. 5–7.

Figure 5:
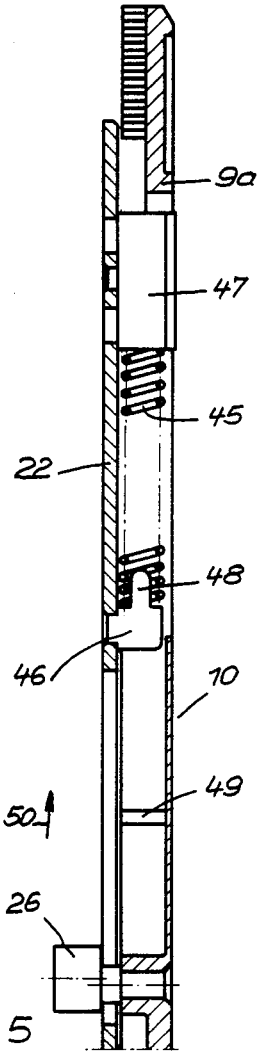
FIGS. 5–7 are sectional views showing on a larger scale detail A of the parts shown in FIG. 4 with each of the figures showing a different switch position of the fitting.
Figure 6:
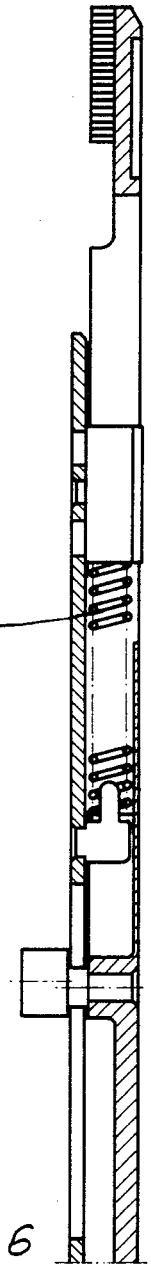

With the panel 2 in the closed and locked position, the catches 49 are in the lower end position seen in FIG. 5. After a 90° rotation of the handle 17, the catches 49 will have traveled upwardly in the direction of the arrow 50 so that now, as shown in FIG. 6, they will have arrived approximately at the lower end of the additional return spring 45 and will abut thereupon. The fitting has, at that, reached the tilt position in which the upper panel end is either released or in a tilt readiness position.

Figure 7:
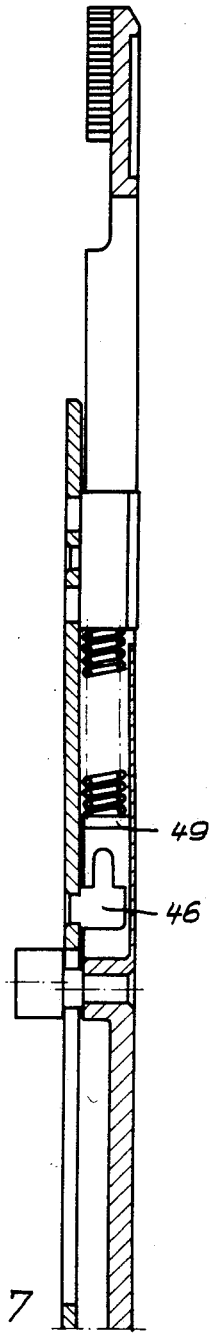

If now the handle 17 is turned further downwardly in the direction of arrow 27 until the position 17*b* is reached, the catches 49 lift the lower spring end off the support member 46, the additional return spring 45 and as well as the return spring 36 will be tensioned and in the parallel offset position of the fitting the position according to FIG. 7 which corresponds to the position shown in FIG. 10. Hence, the additional return spring 45 supports the return of the fitting into the tilted position. The latch member 31 is then in a displacement position which corresponds to that shown in dash-dot line in FIG. 11 but due to its parallel offset resulting from the parallel position of panel 2 it is no longer latched with the latch element 30. The two and possibly additional return springs do indeed bring about a resetting of the drive rods and of all parts coupled therewith but the panel remains in the parallel offset position because release of the lower panel end is not controlled by the drive rods but is brought about by a torque resulting from its dead weight and/or by manual pulling on the handle 17 toward the room.

If the lower panel end is now moved from the position shown in FIG. 3 into the position shown in FIG. 2, the latch lug 41 of the latch member 31 will run up against a ramp 51 of the latch element 30. With sliding of the latch lug 41 along ramp 51 the return spring 36 is again briefly tensioned until latching is completed. Thus, the panel is automatically secured as it is being brought into the parallel offset position into the tilted position. It should further be mentioned that the screws 32 are concealed on the lower panel member so that the latch element 30 cannot be readily removed.

Thus, it will be seen from the foregoing description that the present invention provides a fitting and latching mechanism for a closure assembly adaptable for use in a door or window wherein the movable panel of the assembly may be moved to a tilted position and to a parallel offset position in a secure manner. In order to secure the closure assembly against unintended or undesired parallel offsetting of the panel member when it is in the tilted position there is provided at the lower panel end between the panel and the frame member a lock 29 which consists of the latch element 30 and the latch element 31. In a preferred manner of the invention, a lost motion path prevents displacement of the latch member 31 as the fitting moves from the locking into the tilting position. If the fitting is advanced from the tilt position into the parallel offset position, this leads to movement of the latch member 31 in the direction of arrow 35 and hence to unlocking of the lock 39. The panel may now be moved toward the interior of the room also at the lower end thereof so that it may be laterally offset parallel to itself.

When in the parallel offset position of the fitting or respectively of the three position gear or olive 8, the handle 17 is released and a return spring 36, and also preferably an additional return spring 45, will cause resetting of the fitting. A ramp 51 of the latch member 30 in conjunction with the latch lug 41 of the latch member 31 assures that when the lower panel end flaps back, the lock 29 automatically again goes into the locking position.

While a specific embodiment of the invention has been shown and described in detail to illustrate the application of the inventive principles, it will be understood that the invention may be embodied otherwise without departing from such principles.

What is claimed is:

1. A panel closure assembly for a window, door or the like comprising a frame member, a panel member mounted on said frame member for movement between a closed position and an open position, said panel member being tiltable relative to said frame member at the lower end thereof and also adapted to be laterally offset parallel to itself relative to the frame, and panel latching means including an actuating element and linkage means operable through said actuating element extending from said actuating element at least along said lower end of said panel, said panel member at said lower end thereof being coupled for outward movement with said frame member through lock means adapted to be released by said linkage means, said lock means being adapted to be moved to a release position to enable said outward movement of said lower panel end thereby to enable said laterally offset position of said panel member.

2. An assembly according to claim 1 wherein said lock means comprise a latch element affixed to said frame member and a latch member slidably mounted on said panel member, with said latch member engaging said latch element when said lock means locks said lower end of said panel member against lateral movement thereof, said latch member being slidably movable for disengagement from said latch element when said lock means are moved to said release position.

3. An assembly according to claim 2 wherein said latch element comprises a ramp adapted to be engaged by said latch lug of said latch member, said ramp and said lug cooperating with each other when said panel is pivoted from the lateral offset position into the tilted position.

4. An assembly according to claim 2 wherein said latch element is attached at a lower cross member of said frame.

5. An assembly according to claim 4 wherein said latch member is slidably guided on a cuff bar of said panel member.

6. An assembly according to claim 5 wherein said latch element is formed to be symmetrical both with regard to a plane perpendicular to the drive axis of said drive rod and the latch member and in a plane parallel to the plane of said panel member and passing through a longitudinal median axis of said cuff bar.

7. An assembly according to claim 5 wherein said cuff bar is formed with an opening and wherein said latch member traverses said opening of said cuff bar lengthwise of said cuff bar, said opening having a length approximately equal to the length of said latch member plus a maximum displacement of said latch member, said assembly further including a return spring inserted between said latch member and a transverse edge of said opening.

8. An assembly according to claim 7 wherein one end of said return spring of said latch member engages into a bore thereof and the other end engages over a spike type lug on a transverse edge of the opening of said cuff bar.

9. An assembly according to claim 4 further comprising a return spring engaging said latch member and urging said latch member into engagement with said latch element, said latch member being moved into the disengagement position against the resistance of said return spring.

10. An assembly according to claim 9 wherein said return spring is a helical compression spring.

11. An assembly according to claim 10 wherein said helical compression spring is inserted between said latch member and a surface of said panel member.

12. An assembly according to claim 2 wherein said linkage means comprise a drive rod adapted to engage said latch member to slidably move said latch member out of engagement with said latch element.

13. An assembly according to claim 12 wherein said latch element is formed with a latch edge and wherein said latch member is formed with a latch lug, said latch lug engaging from behind with said latch edge when said lock means is in a locked position.

14. An assembly according to claim 12 wherein said drive rod is adapted to be engaged with a peg member on said latch member, said drive rod being formed with a slot through which said peg member moves during an initial path of movement of said drive rod thereby to provide a lost motion path for said drive rod when said lock means is in the locked position, said lost motion path of said drive rod corresponding to the displacement path thereof during changing of said panel member from a locked position to a position where it may be placed in its tilted position.

15. An assembly according to claim 12 further comprising a corner member having a horizontal leg and a vertical member and wherein said drive rod is coupled with said latch member as part of said corner member with a horizontal leg thereof, said actuating element being in drive connection with said vertical leg of said corner member.

16. An assembly according to claim 15 wherein said drive rod is in coupled engagement with said horizontal leg through an extension drive rod and wherein said actuating element is in drive connection with said vertical leg through a vertical drive rod coupled therewith.

17. An assembly according to claim 15 wherein said actuating element is in drive connection with said drive rod by means of gear means through a catch which is affixed to said drive rod, said gear means comprising a three-position gear mechanism adapted to be switched to a lock position, a tilt position and a parallel offset position of said panel member.

18. An assembly according to claim 17 further comprising an additional return spring which upon displacement of said drive rod to effect the parallel offset position of said panel can be tensioned, said additional return spring being inserted between a closure side of said drive rod and a panel side of a fixed stop in the tilt position of said panel.

19. An assembly according to claim 18 wherein said additional return spring is inserted between two members connected with the closing side of a cuff bar, a catch of the closure side of said drive rod being adapted to move past the support member facing a corner member or respectively past the lower support member of a corner member, with said spring and abutting the support member being located in the movement area of a catch, said catch impinging on said spring approximately in the tilt position of said panel member.

20. An assembly according to claim 19 wherein said two support members for said additional return spring are located on the closure side of said cuff bar formed as part of said corner member.

* * * * *